US009689115B2

(12) United States Patent
Meyers

(10) Patent No.: US 9,689,115 B2
(45) Date of Patent: Jun. 27, 2017

(54) SIZING OF PAPERBOARD

(71) Applicant: WestRock MWV, LLC, Norcross, GA (US)

(72) Inventor: Jeremy P. Meyers, Lumberton, TX (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 14/970,955

(22) Filed: Dec. 16, 2015

(65) Prior Publication Data

US 2016/0186381 A1 Jun. 30, 2016

Related U.S. Application Data

(60) Provisional application No. 62/096,956, filed on Dec. 26, 2014.

(51) Int. Cl.

| | |
|---|---|
| ***D21H 19/14*** | (2006.01) |
| ***D21H 17/16*** | (2006.01) |
| ***D21H 17/62*** | (2006.01) |
| ***D21H 21/16*** | (2006.01) |

(52) U.S. Cl.

CPC ..... *D21H 19/14* (2013.01); *D21H 17/16* (2013.01); *D21H 17/62* (2013.01); *D21H 21/16* (2013.01)

(58) Field of Classification Search

CPC ..... D21H 19/14; D21H 21/16; D21H 17/62; D21H 17/16

USPC ..... 162/158

See application file for complete search history.

(56) References Cited

U.S. PATENT DOCUMENTS

| | | | | |
|---|---|---|---|---|
| 3,139,373 | A | 6/1964 | Winston | |
| 4,302,283 | A | 11/1981 | Blitzer et al. | |
| 4,842,691 | A | 6/1989 | Nakajima et al. | |
| 6,380,299 | B1 | 4/2002 | Fischer et al. | |
| 6,576,049 | B1 * | 6/2003 | Dilts | D21H 21/16 106/219 |
| 7,585,391 | B2 * | 9/2009 | Sundberg | A61L 2/186 162/135 |
| 7,842,362 | B2 * | 11/2010 | Kim | B31C 11/04 428/34.1 |
| 2007/0196602 | A1 * | 8/2007 | Kim | B31C 11/04 428/34.2 |
| 2008/0017020 | A1 * | 1/2008 | Casper | B32B 1/08 89/36.01 |
| 2008/0110587 | A1 | 5/2008 | Sisson et al. | |
| 2009/0074228 | A1 * | 3/2009 | Mango, III | H04R 31/003 381/432 |
| 2012/0248366 | A1 * | 10/2012 | Ehrhardt | D21H 21/16 252/8.83 |
| 2014/0069600 | A1 | 3/2014 | Furman et al. | |

FOREIGN PATENT DOCUMENTS

| | | | |
|---|---|---|---|
| EP | 0593075 | A1 | 4/1994 |
| EP | 0707110 | A1 | 4/1996 |
| WO | WO0188262 | A2 | 4/2002 |

OTHER PUBLICATIONS

International Search Report and Written Opinion for PCT/US2015/067327, Mar. 14, 2016.

"An Investigation of the Mechanism of Alkaline Sizing with Alkenyl Succinic Anhydride." Ph. D. Thesis by William R. McCarthy, State University of New York, College of Environmental Science and Forestry, Syracuse, New York, Jun. 1987.

* cited by examiner

*Primary Examiner* — Mark Halpern

(74) *Attorney, Agent, or Firm* — WestRock Intellectual Property Group

(57) ABSTRACT

Substrates for paperboard packing with improved internal sizing including the use of a combination of a dispersed rosin size (DRS) with an alkenylsuccinic anhydride size for reducing edgewicking with less use of the sizing agents.

18 Claims, 5 Drawing Sheets

SIZING OF PAPERBOARD

REFERENCE TO RELATED APPLICATION

This application claims the benefit of priority under 35 U.S.C. §119(e) of U.S. provisional application Ser. No. 62/096,956 filed on Dec. 26, 2014, which is hereby incorporated by reference in its entirety.

This disclosure relates to a method to treat paperboard with certain combinations of sizing agents that improve or maintain certain properties while using less sizing materials than alternative methods.

In one embodiment the a method is disclosed for making a paperboard web, including providing a paperboard web and applying to the paperboard web an internal sizing agent comprising a combination of a first dosage of dispersed rosin size (DRS) and a second dosage of alkenylsuccinic anhydride (ASA).

In another embodiment a paperboard is disclosed which includes dispersed rosin sizing (DRS) in a first amount from 2 to 8 lb/ton of paperboard on a dry basis; and alkenylsuccinic anhydride (ASA) in an second amount of from 2 to 5 lb/ton of paperboard on a dry basis.

In another embodiment a paperboard is disclosed that includes dispersed rosin sizing (DRS) in a first amount from 2 to 8 lb/ton of paperboard on a dry basis; alkenylsuccinic anhydride (ASA) in an second amount of from 2 to 5 lb/ton of paperboard on a dry basis; wherein the Hercules Size Test (HST) value of said paperboard is at least as high as the HST of paperboard containing a third amount of at least 12 lb/ton of DRS on a dry basis, and substantially no ASA.

BACKGROUND OF THE INVENTION

1. Field of the Invention

This invention relates to substrate for paperboard packaging having an internal sizing agent applied to the paperboard. Internal sizing agents add moisture resistance to the paperboard and, generally, reduce edgewicking in the paperboard. Edgewicking is an undesired occurrence in aseptic liquid packaging and cupstock where liquid penetrates through an internal cut edge of the package or cup, and may weaken the package.

2. Description of the Related Art

Paper machine systems are typically classified as acidic or alkaline, depending on the pH of the pulp slurry provided to the machine. Whether the system is acidic or alkaline will determine what sizing agents may be used in the furnish or on the machine for adding liquid resistance to the paperboard. For acidic systems, a dispersed rosin sizing ("DRS", or "rosin") may be used. For alkaline systems, alkylketene dimer (AKD) may be used, but more systems utilize alkenylsuccinic anhydride (ASA) instead. ASA may also be used in acidic systems.

The ability of sizing agents to attach to cellulose fibers is an important factor in the effectiveness of the sizing agents. The direct to cellulose sizing mechanism of ASA is superior to rosin, and is without certain negative attributes associated with the use AKD.

Adding more sizing agent, up to a point, will improve the liquid resistance (e.g. edgewicking) behaviour, but at additional expense.

SUMMARY OF THE INVENTION

The general purpose of the invention is to use a dual sizing process where a combination of dispersed rosin sizing (DRS) and alkenylsuccinic anhydride (ASA) is applied in an acidic paper machine system. The invention provides a novel method to provide satisfactory edgewick resistance, friction properties, and polymer adhesion on cup stock, aseptic (liquid packaging) and gable top paperboard grades.

DETAILED DESCRIPTION OF THE INVENTION

Figure 1:
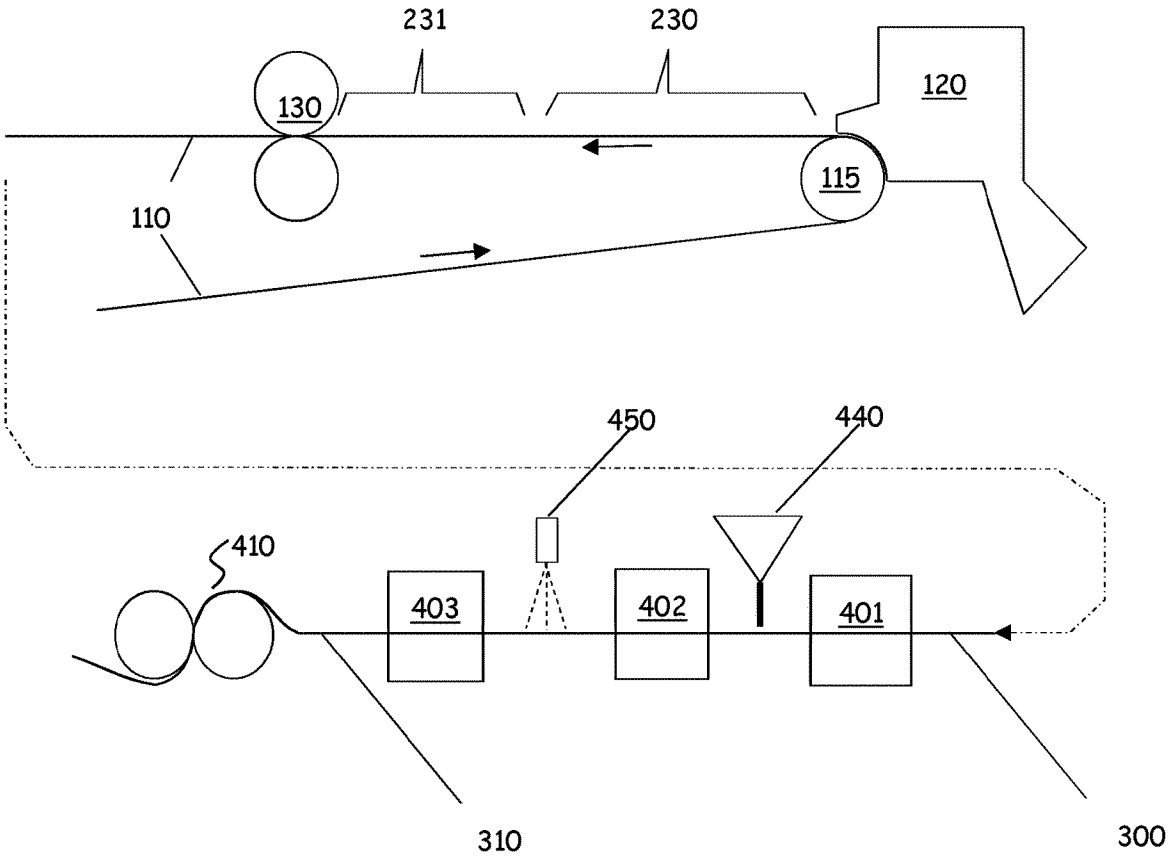
FIG. 1 illustrates a method for applying internal sizing agents to a paperboard web.

FIG. 1 illustrates an exemplary method for making an internally sized paperboard web 310 using a paper machine. A forming wire 110 in the form of an endless belt passes over a breast roll 115 that rotates proximate to a headbox 120. The headbox provides a fiber slurry in water with a fairly low consistency (for example, about 0.5% solids) that passes onto the moving forming wire 110. During a first distance 230 water drains from the slurry and through the forming wire 110, forming a web of wet fibers. The slurry during distance 130 may yet have a wet appearance as there is free water on its surface. At some point as drainage continues the free water may disappear from the surface, and over distance 231, water may continue to drain although the surface appears free from water.

Eventually the web is carried by a transfer felt or press felt through one or more pressing devices such as press rolls 130 that help to further dewatering the web, usually with the application of pressure, vacuum, and sometimes heat. After pressing, the still relatively wet web 300 is dried, for example using dryer or drying sections 401, 402, 403 to produce a dry web ("raw stock") 310 which may then be run through a size press 410 that applies a surface sizing. These steps as described so far are well known in the art of papermaking. The wetter the web, e.g. at zones 230, 231, the more penetration of a sizing agent into the web. However, in these zones some of the sizing agent may be lost into the water being drained away from the web. As the web becomes dryer, sizing agents do not penetrate as far into the web. Thus application of internal sizing agents (like DRS, AKD, or ASA) may not be practical at the size press 410, and is not practical afterward as the surface sizing resists moisture penetration.

As an example, internal sizing agents may be added to the furnish at or before the headbox 120, or in zones 230 or 231 when the web is relatively wet, or at other locations up to the size press 410. Internal sizing agent if applied to the web may be applied as a sheet of liquid by a curtain coater 440, or as droplets by sprays 450. The sizing agents may be applied prior to the size press but do not necessarily have to be applied at the 'wet end.' For example the application may be after the presses or after the top former.

FIGS. 2-5 illustrate the effect of sizing agents at various dosages as measured by handsheet tests. The handsheets for ASA, rosin, or ASA/rosin made using an acidic furnish, while the handsheets for AKD or AKD/rosin were made using a neutral furnish. Differences between the furnishes are listed in Table 1. The results for the handsheets are expected to be somewhat representative of results that might be achieved on a paper machine.

TABLE 1

| Furnish Properties | | |
|---|---|---|
| | Acidic Furnish | Neutral Furnish |
| pH | 4.7 | 6.5 |
| Alum | 10+ lb/ton | 5 lb/ton |

Figure 2:
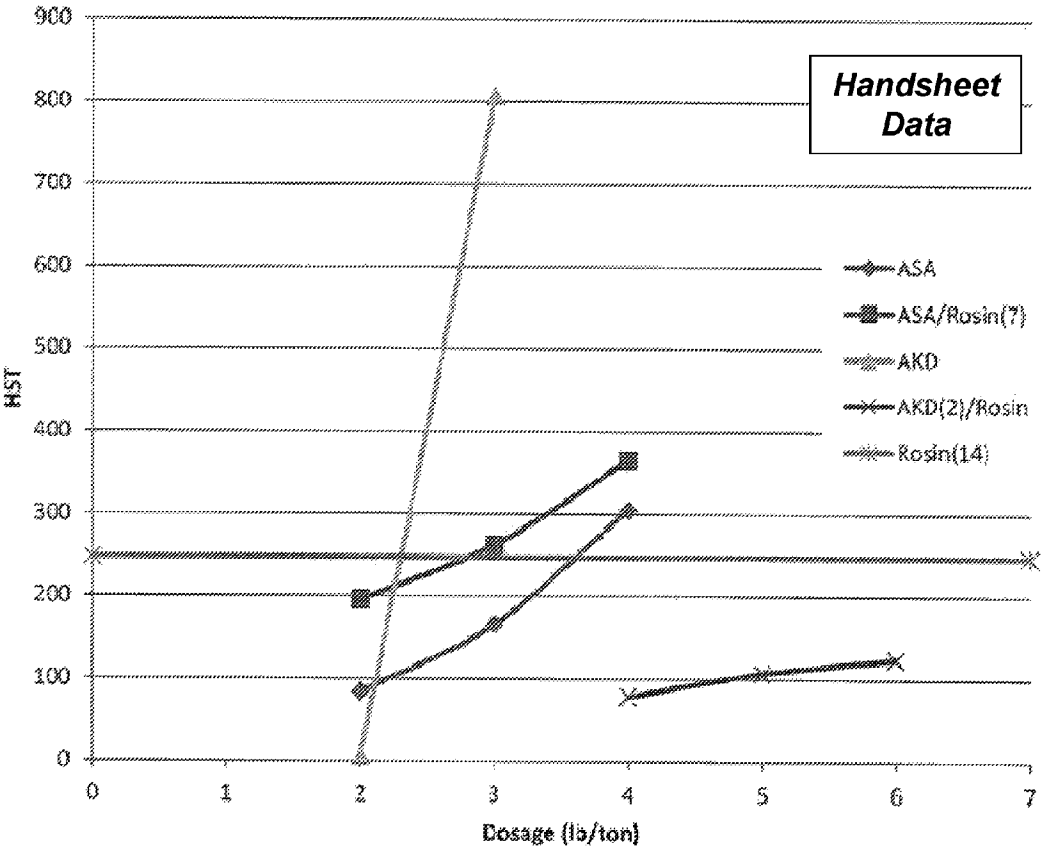
FIG. 2 illustrates the effect of sizing agents at various dosages on the Hercules Size Test (HST)

FIG. 2 shows results for the Hercules Size Test (HST) of the paperboard, higher values being better. The x-axis is the dosage of the agent being varied, except for the "Rosin(14)" line, which HST value of 250 when the rosin dosage was 14 lb/ton.

For ASA alone, the HST value improved, increasing from about 100 to about 300, as the dosage increased from 2 to 4 lb/ton.

For a combination of ASA with a constant 7 lb/ton of rosin—hence the legend "ASA/Rosin(7)"—the HST was somewhat better, improving by an increase from about 200 to about 370 as the ASA dosage increased from 2 to 4 lb/ton. Thus 3 lbs ASA with 7 lb/ton rosin (10 lb/ton total) gave an HST as good as provided by 14 lb/ton rosin.

For AKD Alone, the HST value improved, increasing from about zero to about 800, as the dosage was increased from 2 to 3 lb/ton.

For a combination of rosin with a constant 2 lb/ton of AKD—hence the legend "AKD(2)/Rosin"—the HST value improved by from about 80 to about 120 as the AKD dosage increased from 4 to 6 lb/ton.

Figure 3:
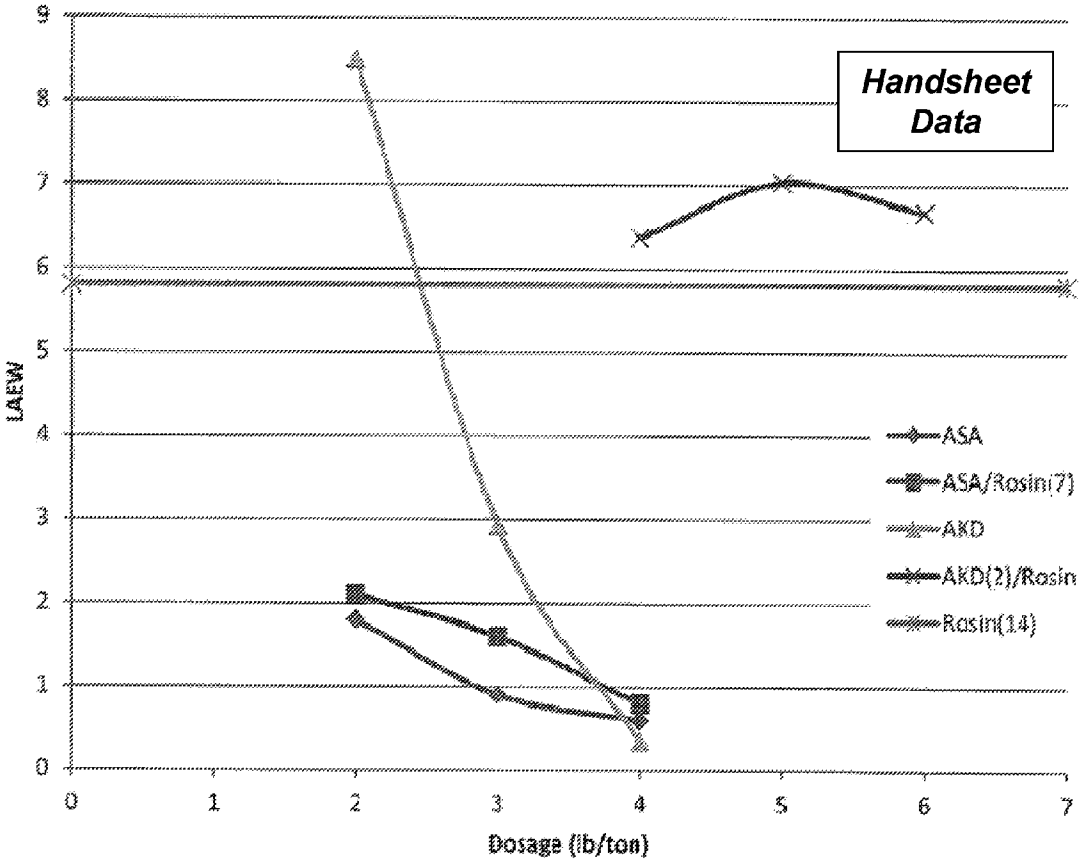
FIG. 3 illustrates the effect of sizing agents at various dosages on the 1-Hour Lactic Acid Edge Wick (LAEW)

FIG. 3 illustrates the effect of sizing agents at various dosages on the 1-Hour Lactic Acid Edge Wick (LAEW), lower values being better. Again as a comparison, a rosin dosage of 14 lb/ton gave a LAEW value of about 5.8.

For ASA alone, the LAEW was significantly better than the rosin-only value, and improved (decreased) from about 1.8 to about 0.6 as the dosage increased from 2 to 4 lb/ton.

For a combination of ASA with a constant 7 lb/ton of rosin the LAEW was also good, dropping from about 2.1 to 1.8 as the ASA dosage increased from 2 to 4 lb/ton. Thus even 2 lb/ton ASA with 7 lb/ton rosin (9 lb/ton total) gave a LAEW much better than provided by 14 lb/ton rosin.

For AKD Alone, the LAEW of 8.5 at a dosage of 2 lb/ton was not as good as the rosin value (at 14 lb/ton), but LAEW values of about 3 to almost zero were achieved as the dosage of AKD dropped to 3 and 4 lb/ton.

For a combination of rosin with a constant 2 lb/ton of AKD, the LAEW varied from about 6.4 to about 7 as the rosin dosage varied from 4 to 6 lb/ton.

Figure 4:
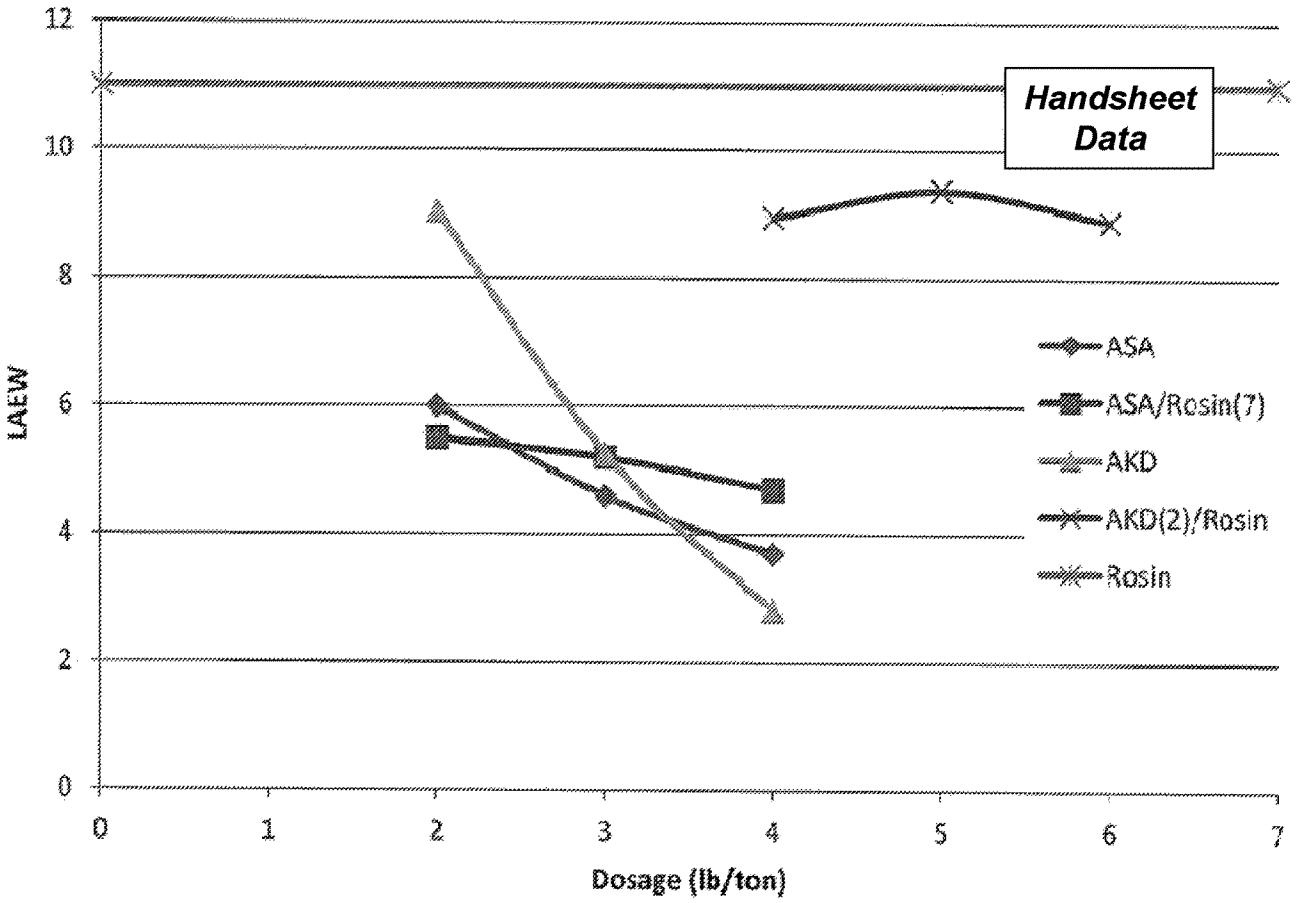
FIG. 4 illustrates the effect of sizing agents at various dosages on the 24-Hour Lactic Acid Edge Wick (LAEW)

FIG. 4 illustrates the effect of sizing agents at various dosages on the 24-Hour Lactic Acid Edge Wick (24-LAEW), lower values being better. Again as a comparison, a rosin dosage of 14 lb/ton gave a LAEW value of about 11.

For ASA alone, the 24-LAEW was significantly better than the rosin-only value, and improved (decreased) from about 6 to about 3.5 as the dosage increased from 2 to 4 lb/ton.

For a combination of ASA with a constant 7 lb/ton of rosin the 24-LAEW was also good, dropping from about 5.5 to 5 as the ASA dosage increased from 2 to 4 lb/ton. Thus 2 lb/ton ASA with 7 lbs rosin (9 lb/ton total) gave a 24-LAEW much better than provided by 14 lb/ton rosin.

For AKD Alone, the 24-LAEW of fell (improved) from 9 down to 2.5 as the dosage increased from 2 to 4 lb/ton.

For a combination of rosin with a constant 2 lb/ton of AKD, the 24-LAEW was about 9 for rosin dosages from 4 to 6 lb/ton.

Figure 5:
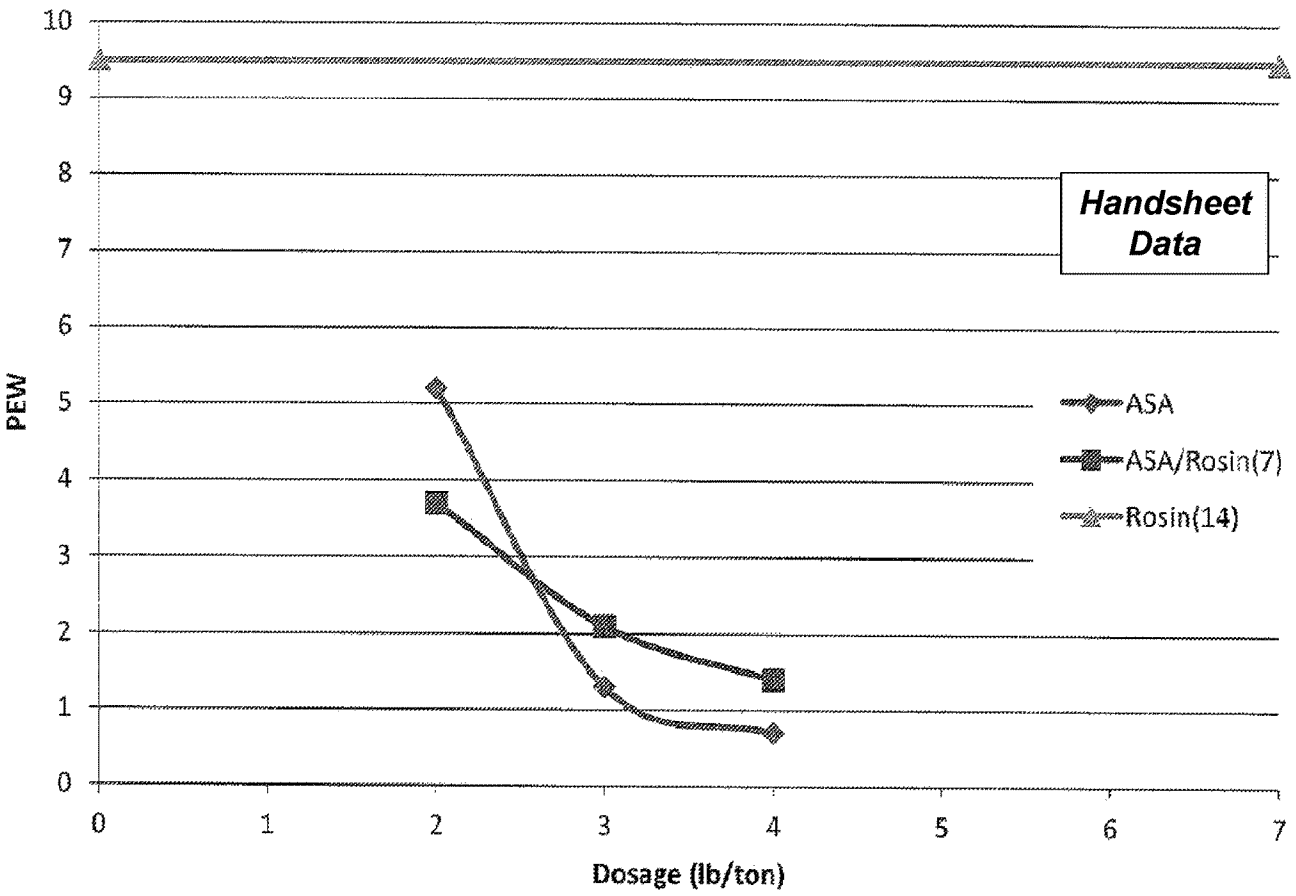
FIG. 5 illustrates the effect of sizing agents at various dosages on the Peroxide Edge Wick (PEW).

FIG. 5 illustrates the effect of sizing agents at various dosages on the Peroxide Edge Wick (PEW). FIG. 5 illustrates the effect of sizing agents at various dosages on the Peroxide Edge Wick (PEW), lower values being better. Again as a comparison, a rosin dosage of 14 lb/ton gave a PEW value of about 9.5.

For ASA alone, the PEW was significantly better than the rosin-only value, and improved (decreased) from about 5.2 to about 1.7 as the dosage increased from 2 to 4 lb/ton.

For a combination of ASA with a constant 7 lb/ton of rosin the PEW was also good, dropping from about 3.7 to 1.4 as the ASA dosage increased from 2 to 4 lb/ton. Thus 3 lb/ton ASA with 7 lb/ton rosin (10 lb/ton total) gave a PEW much better than provided by 14 lb/ton rosin.

Thus, it has been found that the use of rosin and ASA in combination to internally size the paperboard results in equivalent or better paperboard properties with less overall sizing agent that required with rosin alone. Compared with using only dispersed rosin size, the inventive method is more economical, since less sizing agent is needed. While particular example dosages are shown in FIGS. 2-5, the benefits of the combination of rosin with ASA are not necessarily limited to the values represented by the example data but may extend to other dosages as well.

In addition to using less sizing agent, certain other benefits may be realized. ASA tends to hydrolyze and form a sticky material that can build up on the machine surfaces. Compared with using only ASA, using ASA with rosin the inventive method results in less hydrolysate buildup on the paper machine surface.

Compared with AKD, the inventive method is found to have less effect on the coefficient of friction. AKD by itself can reduce the coefficient of friction, making the paperboard 'slippery', which is undesired. Using ASA does not have this detrimental effect. Also compared against AKD, the inventive method provides better polymer adhesion, particularly when the applied polymers are polylactic acid or polypropylene.

Compared with using only dispersed rosin size, the inventive method is expected to have less drying demand since less water is retained within the wet web.

Finally, the use of ASA with rosin should provide more resistance than rosin alone against penetrants that react with alum mordants.

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

The invention claimed is:

1. A method of making a paperboard web, comprising:

providing a paperboard web;

applying to the paperboard web an internal sizing agent comprising a combination of a first dosage of dispersed rosin size (DRS) and a second dosage of alkenylsuccinic anhydride (ASA);

wherein the first dosage ranges from about 2 to about 8 lbs of DRS per ton of paperboard on a dry basis, the second dosage ranges from about 2 to about 5 lbs of ASA per ton of paperboard on a dry basis, and wherein the second dosage is less than the first dosage.

2. The method of claim 1, wherein the first dosage ranges from about 6 to 8 lbs of DRS per ton of paperboard web, on a dry basis.

3. Paperboard produced by the method of claim 1.

4. A paperboard comprising:

dispersed rosin sizing (DRS) in a first amount from 2 to 8 lb/ton of paperboard on a dry basis; and alkenylsuccinic anhydride (ASA) in a second amount of from 2 to 5 lb/ton of paperboard on a dry basis.

5. Paperboard as in claim 4, wherein the first amount is DRS from 6 to 8 lb/ton of paperboard on a dry basis.

6. Paperboard as in claim 4, wherein the 1-hour Lactic Acid Edgewick test has a value of less than about 2.

7. Paperboard as in claim 6, wherein the 1-hour Lactic Acid Edgewick test has a value of less than about 1.

8. Paperboard as in claim 4, wherein the 24-hour Lactic Acid Edgewick test has a value of less than about 6.

9. Paperboard as in claim 8, wherein the 24-hour Lactic Acid Edgewick test has a value of less than about 5.

10. Paperboard as in claim 4, wherein the Peroxide Edgewick test has a value of less than about 6.

11. Paperboard as in claim 10, wherein the Peroxide Edgewick test has a value of less than about 2.

12. Paperboard as in claim 4, wherein the 1-hour Lactic Acid Edgewick test has a value of less than about 1, the 24-hour Lactic Acid Edgewick test has a value of less than about 5, and the Peroxide Edgewick test has a value of less than about 2.

13. A paperboard comprising:

dispersed rosin sizing (DRS) in a first amount from 2 to 8 lb/ton of paperboard on a dry basis;

alkenylsuccinic anhydride (ASA) in a second amount of from 2 to 5 lb/ton of paperboard on a dry basis;

wherein the Hercules Size Test (HST) value of said paperboard is at least as high as the HST of paperboard containing a third amount of DRS at least 12 lb/ton of paperboard on a dry basis, and substantially no ASA.

14. Paperboard as in claim 13, wherein the first amount is DRS from 6 to 8 lb/ton of paperboard on a dry basis.

15. Paperboard as in claim 13, wherein the second amount is ASA from 3 to 4 lb/ton of paperboard on a dry basis and the third dosage is DRS from 13 to 14 lb/ton of paperboard on a dry basis.

16. Paperboard as in claim 13, wherein the 1-hour Lactic Acid Edgewick test has a value of less than about 1.

17. Paperboard as in claim 13, wherein the 24-hour Lactic Acid Edgewick test has a value of less than about 5.

18. Paperboard as in claim 13, wherein the Peroxide Edgewick test has a value of less than about 2.

* * * * *